US008168572B2

(12) United States Patent
Thoen et al.

(10) Patent No.: US 8,168,572 B2
(45) Date of Patent: May 1, 2012

(54) LUBRICANT BLEND COMPOSITION

(75) Inventors: Johan A. Thoen, Antwerp (BE); Rene Geiger, Ruechlikon (CH); Martin R. Greaves, Hirzel (CH); David C. Busby, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 257 days.

(21) Appl. No.: 12/593,472

(22) PCT Filed: Apr. 1, 2008

(86) PCT No.: PCT/US2008/058970

§ 371 (c)(1),
(2), (4) Date: Sep. 28, 2009

(87) PCT Pub. No.: WO2008/134179

PCT Pub. Date: Nov. 6, 2008

(65) Prior Publication Data

US 2010/0120639 A1 May 13, 2010

Related U.S. Application Data

(60) Provisional application No. 60/926,201, filed on Apr. 25, 2007.

(51) Int. Cl.
*C10M 101/04* (2006.01)
*C10M 159/08* (2006.01)
*C10M 169/04* (2006.01)

(52) U.S. Cl. ..... 508/491; 508/456; 508/486

(58) Field of Classification Search ..... 508/456, 508/486, 491

See application file for complete search history.

(56) References Cited

U.S. PATENT DOCUMENTS

| | | | | |
|---|---|---|---|---|
| 5,171,861 | A * | 12/1992 | Ernhoffer et al. | 508/231 |
| 5,335,471 | A | 8/1994 | Kupiec | |
| 5,413,725 | A | 5/1995 | Lal et al. | |
| 5,451,334 | A | 9/1995 | Bongardt et al. | |
| 5,531,911 | A | 7/1996 | Adams et al. | |
| 5,538,654 | A | 7/1996 | Lawate et al. | |
| 5,552,068 | A | 9/1996 | Griffith | |
| 5,773,391 | A | 6/1998 | Lawate et al. | |
| 5,902,777 | A | 5/1999 | Hashimoto et al. | |
| 5,949,017 | A | 9/1999 | Oommen et al. | |
| 5,972,854 | A | 10/1999 | Ichihashi et al. | |
| 6,160,144 | A | 12/2000 | Bongardt et al. | |
| 6,278,006 | B1 | 8/2001 | Kodali et al. | |
| 6,300,292 | B2 | 10/2001 | Konishi et al. | |
| 6,383,992 | B1 * | 5/2002 | Garmier et al. | 508/491 |
| 6,511,947 | B1 | 1/2003 | Nakanishi et al. | |
| 6,534,454 | B1 | 3/2003 | Garmier et al. | |
| 2003/0171227 | A1 | 9/2003 | Holt et al. | |
| 2004/0241309 | A1 | 12/2004 | Garmier | |
| 2005/0059562 | A1 * | 3/2005 | Garmier | 508/437 |
| 2006/0193802 | A1 | 8/2006 | Lysenko et al. | |
| 2007/0010607 | A1 | 1/2007 | Smith et al. | |
| 2007/0142243 | A1 | 6/2007 | Cherpeck et al. | |

FOREIGN PATENT DOCUMENTS

| | | | |
|---|---|---|---|
| EP | 0678569 | A2 | 10/1995 |
| EP | 1063279 | A1 | 12/2000 |
| WO | WO-9712949 | A1 | 4/1997 |
| WO | WO-0102521 | | 1/2001 |
| WO | WO-0148127 | | 7/2001 |
| WO | WO-02077135 | A1 | 10/2002 |
| WO | WO-2005026300 | A1 | 3/2005 |
| WO | WO-2006120216 | A1 | 11/2006 |

OTHER PUBLICATIONS

Hamblin; Oxidative Stabilisation of Synthetic Fluids and Vegetable Oils; XP-002519343, Jul. 1999.

Erhan et al.; Oxidation and low temperature stability of vegetable oil-based lubricants; ScienceDirect; Industrial Crops and Products 24; pp. 292-299 (2006).

* cited by examiner

*Primary Examiner* — Walter D Griffin
*Assistant Examiner* — Francis C Campanell

(57) ABSTRACT

The present invention relates to a lubricant composition. The present invention more particularly relates to a fully miscible lubricant composition that comprise a polyether and a renewable raw material such as an unsaturated seed or vegetable oil.

14 Claims, No Drawings

LUBRICANT BLEND COMPOSITION

The present invention relates generally to a lubricant composition. The present invention relates particularly to fully miscible lubricant compositions that comprise a polyether and a renewable raw material source such as an unsaturated seed or vegetable oil, whether genetically modified or not. The present invention relates more particularly to such compositions in conjunction with one or more of a wear-reducing additive, especially an amine phosphate, an antioxidant, especially a phenolic antioxidant, an amine antioxidant or a combination of a phenolic antioxidant and an amine antioxidant, and a corrosion inhibitor such as a sodium salt of dinonylnaphthalene sulfonic acid or a calcium salt of dinonylnaphthalene sulfonic acid.

"Bio-lubricants", or lubricants based upon renewable resources such as seed oils and vegetable oils rather than from petroleum or natural gas, represent a small, but growing segment of total global lubricants demand. Bio-lubricants find particular favor in environmentally sensitive applications such as marine, forestry or agricultural lubricants due to observations that they readily biodegrade, have low toxicity and do not appear to harm aquatic organisms and surrounding vegetation. In at least partial recognition of such observations, Germany and Austria ban use of mineral oils in total loss lubrication applications such as chain saw lubrication and Portugal and Belgium mandate use of biodegradable lubricants in outboard engines. Technical performance shortcomings of unmodified seed oils, relative to synthetic lubricants derived from petroleum or natural gas such as polyolesters, polyalkylene glycols and poly(alpha-olefins), in terms of hydrolytic stability, oxidative stability and low temperature properties including pour point limit growth of neat (no additives), unmodified seed oils as bio-lubricants. For example, in cold climates (temperatures below −10° centigrade (° C.)), vegetable oils tend to solidify more readily than petroleum-based products and, accordingly, have relatively high (greater than −10° C.) pour point temperatures. Addition of a pour point depressant to vegetable oils yields a composition with lower pour point temperature than that of neat vegetable oil.

U.S. Pat. No. 5,335,471 discloses use of methacrylate and styrene/maleic anhydride interpolymers as pour point depressant additives for seed oil lubricants.

U.S. Pat. No. 5,413,725 teaches use of the same interpolymers as pour point depressant additives for seed oil lubricants derived from high oleic containing feedstocks.

As used throughout this specification, definitions presented in this paragraph, in succeeding paragraphs or elsewhere in the specification, have meanings ascribed to them where first defined.

When ranges are stated herein, as in a range of from 2 to 10, both end points of the range (e.g. 2 and 10) are included within the range unless otherwise specifically excluded.

An aspect of the present invention is a lubricant blend composition comprising at least one first component, the first component being a vegetable oil or seed oil, and at least one second component, the second component being a polyether, the blend having an ASTM D97-87 pour point of −10° C. or lower, a viscosity at 40° C. within a range of from 10 square millimeters per second ($mm^2/s$) to 100 $mm^2/s$, a viscosity at 100° C. within a range of from 2.4 $mm^2/s$ to 20 $mm^2/s$, and a viscosity index (VI) within a range of from 30 to 225.

In a first related aspect, the second component comprises a combination of the polyether and a polyolester. Inclusion of a polyolester does not cause the blend to have an ASTM D97-87 pour point in excess of −10° C. (e.g. −5° C.) or to have a viscosity at either 40° C. or 100° C. or a VI outside the ranges noted in the first aspect.

In a second related aspect, which applies to either the aspect or the first related aspect, the lubricant blend composition further comprises a wear-reducing amount of amine phosphate.

In a third related aspect, which applies to any of the aspect, the first related aspect or the second related aspect, the lubricant blend composition further comprises an antioxidant selected from a group consisting of phenolic antioxidants and amine antioxidants.

In a fourth related aspect, which applies to the aspect or any of its first through third related aspects, the lubricant blend composition further comprises a corrosion-inhibiting amount of a sodium salt of dinonylnaphthalene sulfonic acid.

In a fifth related aspect, the lubricant blend composition of the aspect or any of its first through fourth related aspects, further comprises a demulsfier.

The lubricant blend compositions of either the aspect or any of the related aspects have a variety of end use applications, one of which is as a power transmission fluid. See e.g. Verband Deutscher Maschinen and Anlagen bau e. V. (VDMA) 24568 (minimum technical requirements for biodegradable hydraulic fluids, specified according to ISO 15380:2002.

References to the Periodic Table of the Elements herein shall refer to the Periodic Table of the Elements, published and copyrighted by CRC Press, Inc., 2003. Also, any references to a Group or Groups shall be to the Group or Groups reflected in this Periodic Table of the Elements using the IUPAC system for numbering groups.

Unless stated to the contrary, implicit from the context, or customary in the art, all parts and percents are based on weight. For purposes of United States patent practice, the contents of any patent, patent application, or publication referenced herein are hereby incorporated by reference in their entirety (or the equivalent US version thereof is so incorporated by reference) especially with respect to the disclosure of synthetic techniques, definitions (to the extent not inconsistent with any definitions provided herein) and general knowledge in the art.

The term "comprising" and derivatives thereof does not exclude the presence of any additional component, step or procedure, whether or not the same is disclosed herein. In order to avoid any doubt, all compositions claimed herein through use of the term "comprising" may include any additional additive, adjuvant, or compound whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed. The term "or", unless stated otherwise, refers to the listed members individually as well as in any combination.

"Oleic acid" means cis-9,10-octadecenoic acid.

Expressions of temperature may be in terms either of degrees Fahrenheit (° F.) together with its equivalent in ° C. or, more typically, simply in ° C.

Lubricant blends of the present invention (the aspect and any of its related aspects as detailed above) comprise at least one first component and at least one second component. A renewable raw material source such as an unsaturated seed or vegetable oil, whether genetically modified or not, serves as a preferred first component. A polyether constitutes a preferred second component. Relative amounts of first and second components in such lubricant blends vary depending upon whether one desires classification of the lubricant blend as simply a bin-lubricant in general, something that requires a discernible amount (e.g. as little as 5 percent by weight (wt %), based upon composition weight) of a renewable raw material, or classification in accord with renewable raw material criteria outlined in European Economic Community (EEC) lubricants eco-label regulations (Official Journal of the European Union, 5.5.2005, Commission Decision of 26 Apr. 2005, establishing ecological criteria and the related assessment and verification requirements for the award of the Community eco-label to lubricants). The latter criteria require that at least 50 wt %, based upon composition weight, of carbon atoms contained in a lubricant composition be supplied from a renewable resource.

For lubricant blends that need not meet the EEC lubricants eco-label regulations, the first component or renewable raw material source constitutes, based upon combined weight of first and second components, more than 10 wt %, preferably at least 15 wt % and even more preferably at least 20 wt % up to 95 wt %, more preferably up to 90 wt %, still more preferably up to 85 wt %, with up to 80 wt % or even up to 50 wt % being satisfactory. For lubricant blends that must meet the EEC lubricants eco-label regulations, the renewable resource constitutes, based upon lubricant blend weight, at least 50 wt %, more preferably at least 60 wt % and still more preferably at least 70 wt % up to 95 wt %, more preferably up to 90 wt % and even more preferably up to 85 wt % with up to 80 wt % providing very satisfactory results. The second component is present in an amount that complements the amount of the first component such that the weight percentages of first and second components, when added together, total 100 wt % in each instance. For example, a first component content of at least 5 wt % complements a second component content of up to 95 wt %.

U.S. Patent Application Publication (USPAP) 2006/0193802 (Lysenko et al.), the relevant teachings of which are incorporated herein by reference, lists illustrative plant and vegetable seed oils in paragraph [0030]. Such oils include palm oil, palm kernel oil, castor oil, soybean oil, olive oil, peanut oil, rapeseed oil, corn oil, sesame seed oil, cottonseed oil, canola oil, safflower oil, linseed oil, sunflower oil; high oleic oils (e.g. an oleic acid content of from about 70 wt % to 90 wt %, based upon total oil weight) such as high oleic sunflower oil, high oleic safflower oil, high oleic corn oil, high oleic rapeseed oil, high oleic soybean oil and high oleic cottonseed oil; genetically-modified variations of oils noted in this paragraph, and mixtures thereof.

Preferred first component seed oils include the aforementioned high oleic oils, with high oleic sunflower oil and high oleic canola oil being especially preferred. High oleic oils, especially high oleic oils with a 12 carbon atom and higher carbon number saturated hydrocarbon (collectively $C_{12+}$) content within a range of from 0 wt % to 32 wt %, particularly less than 10 wt %, tend to have greater thermo-oxidative stability and lower pour points than their natural oil counterpart (e.g. high oleic sunflower oil versus natural sunflower oil).

Preferred polyethers of the second component may be represented by chemical Formula 1:

$$R—[—X—(CH_2—CH_2O)_n(C_yH_{2y}O)_p—Z]_m \qquad \text{Formula I}$$

wherein R is either H (hydrogen), or an alkyl or aryl (e.g. phenyl or substituted phenyl such as alkylphenyl) group having from 1 to 30 carbons ($C_{1-30}$); X is either O (oxygen), or S (sulfur) or N (nitrogen); y is an integer within a range of from 3 to 30; Z is H or a $C_{1-30}$ hydrocarbyl or $C_{1-30}$ hydrocarboxyl group; a sum of n+p ranges from 6 to 60 with n and p being selected such that the polyether contains $CH_2$—$CH_2O$ groups in an amount within a range of from 0 wt % to 60 wt % and $C_yH_{2y}O$ groups in an amount within a range of from 100 wt % to 40 wt %, each wt % being based upon combined weight of $CH_2$—$CH_2O$ groups and $C_yH_{2y}O$ groups; and m is within a range of from 1 to 8. The $C_yH_{2y}O$ group is preferably a propylene oxide group. The polyether preferably has a number average molecular weight ($M_n$) within a range of from 500 and 3,500. Table 1 below shows several polyethers that are miscible, in a 60/40 (weight/weight) ratio, with a vegetable oil (e.g. NATREON™ high oleic sunflower oil or NATREON high oleic canola, both commercially available from Dow AgroScience, or TRISUN™ high oleic sunflower oil, commercially available from ACH Food Companies Inc.). The polyethers in Table 1 all have a molecular weight within the range of from 500 to 3,500 and match Formula I. Table 1 also includes polyolesters that are miscible with vegetable oils and polyethers. In Table 1, "Butanol DPnB" means butanol plus two moles of propylene oxide, "M" equals mix feed (feed both ethylene oxide (EO) and propylene oxide (PO) as a homogeneous mixture to a reactor); "H" means homopolymer (feed either PO or EO, preferably PO, to the reactor); "B" means block copolymer (feed PO to the reactor, complete reaction of the PO, then add EO to the reactor); and "RB" means reverse block (feed EO to the reactor, complete reaction of the EO, then add PO to the reactor). In Table 1, "45/55" means a 45/55 (weight/weight) ratio blend of $C_8$ and $C_{10}$ fatty alcohols. "Seq", as used in Table 1, means H or B or RB, whichever is appropriate.

The polyether is preferably a polyalkylene glycol or modified polyalkylene glycol. In embodiments of this invention wherein the polyether is a modified polyalkylene glycol, the modified polyalkylene glycol is an end-capped polyalkylene glycol. The end-capped polyalkylene glycol preferably includes a non-reactive end-capping moiety selected from a group consisting of a) an alkyl ether, the alkyl ether having an alkyl moiety that contains from one to 1-30 carbon atoms, b) an aromatic ether, c) an ester, and d) a sterically hindered active hydrogen, hydrocarhyl or hydrocarboxy group.

In some embodiments of this invention, the second component is miscible with the first component.

In other embodiments of this invention, the second component is a blend of a polyether and a polyolester, the polyolester being a synthetic ester of a polyhydric alcohol and a $C_6$-$C_{22}$ acid (acid with six to 22 carbon atoms). Preferred polyhydric alcohols include at least one of trimethylolpropane, neopentylglycol, pentaerythritol, and 1,2,3-trihydroxypropanol.

TABLE 1

| | Seq | R | X | y | n | p | n + p | % EO | % CyH2yO | Z | MWT | Misc. Veg Oil/PAG 60/40 |
|---|---|---|---|---|---|---|---|---|---|---|---|---|
| polyether-1 | H | Butanol DPnB | O | 3 | 0 | 16 | 16 | 0 | 100% PO | H | 1000 | Yes |

TABLE 1-continued

| | Seq | R | X | y | n | p | n + p | % EO | % CyH2yO | Z | MWT | Misc. Veg Oil/PAG 60/40 |
|---|---|---|---|---|---|---|---|---|---|---|---|---|
| polyether-2 | H | Monopropylene glycol (H) | O | 3 | 0 | 17 | 17 | 0 | 100% PO | H | 1000 | Yes |
| polyether-3 | H | Monopropylene glycol (H) | O | 3 | 0 | 34 | 34 | 0 | 100% PO | H | 2000 | Yes |
| polyether-4 | B | $C_{10}$-$C_{15}$ fatty alcohol (RB) | O | 3 | 6 | 4 | 10 | 53 | 47% PO | H | 700 | Yes |
| polyether-5 | H | Butanol DPnB | O | 3 | 0 | 23 | 23 | 0 | 100% PO | $CH_3$ | 1400 | Yes |
| polyether-6 | H | Butanol DPnB | O | 3 | 0 | 23 | 23 | 0 | 100% PO | H | 1400 | Yes |
| polyether-7 | B | 45/55 (weight/weight) blend of n-octanol and n-decanol (RB) | O | 3 | 5.7 | 3.1 | 8.8 | 58 | 42% PO | H | 630 | Yes |
| polyether-8 | B | 45/55 (weight/weight) blend of n-octanol and n-decanol | O | 3 | 11 | 10 | 21 | 45 | 55% PO | Benzyl | 1350 | Yes |
| polyolester-1 | Trimethylolpropane - $C_8/C_{10}$ ester, viscosity (at 40° C.) of 17.5 to 20.0 $mm^2/s$, a VI of 143, and a saponification number of 309 to 329 milligrams of potassium hydroxide per gram (mg KOH/g), miscible in a 60/40 Vegetable Oil/PAG mixture. | | | | | | | | | | | |
| polyolester-2 | Trimethylolpropane - $C_8/C_{10}$ unsaturated ester viscosity (at 40° C.) of 65 $mm^2/s$, a VI of 208, and a saponification number of 185 mg KOH/g, miscible in a 60/40 Vegetable Oil/PAG mixture. | | | | | | | | | | | |

Determine miscibility of a lubricant composition that comprises a polyether and a renewable raw material source such as an unsaturated seed or vegetable oil, whether genetically modified or not, at room temperature (nominally 25° C.) by visual observation. Miscible blends or compositions appear as clear homogeneous liquids with no apparent phase separation.

Lubricant blend compositions of the present invention have a pour point (e.g. a temperature at which an oil ceases to flow) that is preferably −10° C. or less, more preferably −15° C. or less, even more preferably −20° C. or less, still more preferably, −25° C. or less and most preferably −27° C. or less. The phrase "or less" means lower in temperature. For example −15° C. is less than −10° C.

Vegetable oils, especially those with a high monounsaturation content, tend to stiffen at low temperatures. This resembles stiffening of honey or molasses at such low temperatures (e.g. −10° C.).

Pour point depressants permit flow of lubricant blend compositions at a temperature below the pour point of a lubricant blend composition that lacks a pour point depressant. Lubricants that offer low pour points (e.g. less than (<)−25° C.) find utility in equipment that needs to operate in cold climates. Common pour point depressants include polymethacrylates, styrene/maleic anhydride copolymers, wax alkylated naphthalene polymers, wax alkylated phenol polymers and chlorinated polymers. See, e.g. U.S. Pat. No. 5,451,334 and U.S. Pat. No. 5,413,725. Lubricant blend compositions of the present invention preferably include an amount of pour point depressant that is about 2 wt % or less, preferably 1 wt % or less, each wt % being based upon total composition weight (including the pour point depressant). Skilled artisans also recognize that pour point depressant amounts in excess of about two percent by weight (2 wt %), based upon total composition weight (including the pour point depressant) typically yield minimal further improvement in pour point, but do increase composition cost. A preferred pour point depressant for vegetable oil based lubricants is a polyacrylate (e.g. L7671A, commercially available from Lubrizol Corporation).

In addition to a pour point depressant, lubricant blend compositions of the present invention optionally, but preferably, include an additive package that comprises at least one of a stabilizer (e.g. an antioxidant), a corrosion inhibitor, an emulsion breaker and an anti-wear additive. The additive package typically provides an improvement, relative to an identical composition save for absence of the additive package, in one or more of oxidation resistance, thermal stability, anti-rust performance, extreme pressure antiwear performance, anti-foam characteristics, air release properties and filtration. A particularly suitable additive package is available from Lubrizol Corporation under the trade designation L5186B.

Lubricant blend compositions of the present invention can include one or more additives and still remain suitable for use as cost effective, high performance, and readily biodegradable industrial oils, such as high performance hydraulic fluids or engine lubricants. Typically, additives are present in amounts totaling from about 0.001 wt % to about 20 wt % based on total lubricant blend composition weight. For example, a transmission fluid for diesel engines can be made that includes antioxidants, anti-foam additives, anti-wear additives, corrosion inhibitors, dispersants, detergents, and acid neutralizers, or combinations thereof. Hydraulic oil formulations can include antioxidants, anti-rust additives, anti-wear additives, pour point depressants, viscosity-index improvers and anti-foam additives or combinations thereof. Specific oil formulations will vary depending on the end use of the oil; suitability of a specific formulation for a particular use can be assessed using standard techniques.

Typical antioxidants are aromatic amines, phenols, compounds containing sulfur or selenium, dithiophosphates, sulfurized polyalkenes, and tocopherols. The antioxidant is preferably selected from a group consisting of phenolic antioxidants, amine antioxidants or a mixture of a phenolic antioxidant and an amine antioxidant. The antioxidant is more preferably a phenolic antioxidant that has molecular weight ($M_w$) of at least 220 (e.g. butylated hydroxytoluene or BHT). Hindered phenols are particularly useful, and include for example, 2,6-di-tert-butyl-p-cresol (DBPC), tert-butyl hydroquinone (TBHQ), cyclohexylphenol, and p-phenylphenol. Examples of amine-type antioxidants include phenylamine, naphthylamine, alkylated di phenylamines and unsymmetrical diphenylhydrazine. Zinc dithiophosphates, metal dithiocarbamates, phenol sulfides, metal phenol sulfides, metal salicylates, phospho-sulfurized fats and olefins, sulfurized olefins, sulfurized fats and fat derivatives, sulfurized paraffins, sulfurized carboxylic acids, disalieylal-1,2,-propane diamine, 2,4-bis(alkyldithio)-1,3,4-thiadiazoles) and dilauryl selenide are examples of useful antioxidants. Lubrizol product #121056F (Wickliffe, Ohio) provides a mixture of antioxidants that is particularly useful. Antioxidants are typically present in amounts from about 0.001 wt % to about 10 wt %, preferably from 0.5 wt % to 10 wt %, in each case based upon total weight of the lubricant blend composition. In particular embodiments, from 0.01 wt % to 3 wt %, more preferably from 0.5 wt % to 2 wt %, based upon total weight of the lubricant blend composition, of an antioxidant is added to a lubricant blend composition of the present invention. See U.S. Pat. No. 5,451,334 and U.S. Pat. No. 5,773,391 for a description of additional antioxidants.

Rust inhibitors protect surfaces against rust and include alkylsuccinic type organic acids and derivatives thereof, alkylthioacetic acids and derivatives thereof, organic amines and alkanolamines, organic phosphates, imidazolines, polyhydric alcohols, and sodium and calcium sulfonates.

Anti-wear additives adsorb on metal, and provide a film that reduces metal-to-metal contact. In general, anti-wear additives include, for example, zinc dialkyldithiophosphates, tricresyl phosphate, didodecyl phosphite, sulfurized sperm oil, sulfurized terpenes and zinc dialkyldithiocarbamate, and are used in amounts from about 0.05 wt % to about 4.5 wt %, based upon total lubricant blend composition weight. Preferred commercially available anti-wear additives include organic sulfur and phosphorous compounds sold by RT Vanderbilt under trade name VANLUBE™ 7611M, amine salts of aliphatic phosphorous acid esters (e.g. NALUBE™ AW6110, King industries), sulfur-phosphorous-nitrogen compounds such as NALUBE™ AW6310 (King Industries), phosphorous-sulfur compounds such as NALUBE™ AW6330 (King Industries), amine phosphate, heterocyclic derivatives such as NALUBE™ AW6220 (King Industries), triphenyl phosphorothionate (IRGALUBE™ TPPT, Ciba), a combination of an aromatic glyceride (70-80 wt %) and a petroleum solvent (30-20 wt %) (IRGALUBE™ FIOA, Ciba), a combination of amines and C22-C14 branched alkyl, monohexyl and dihexyl phosphates (IRGALUBE™ 349, Ciba), a combination of alkyl dithio thiazol and 3-[[bis(1-methylethoxy)-phosphinothioyl]thio]propanoic acid, ethyl ester (IRGALUBE™ 63, Ciba), a mixture of phosphate derivatives (IRGALUBE™ 232, Ciba) and dithiophosphate (IRGALUBE™ 353, Ciba). The anti-wear additive is preferably an amine phosphate that is present in a wear-reducing amount. The wear-reducing amount is preferably within a range of from 0.05 wt % to 3 wt %, each weight percentage being based upon total composition weight. Some anti-wear additives (e.g. NALUBE™ AW6110, King Industries) also provide a measure of ferrous metal corrosion inhibition at such an amount.

Corrosion inhibitors include dithiophosphates and in particular, zinc dithiophosphates, metal sulfonates, metal phenate sulfides, fatty acids and their amine or alkanolamine salts, acid phosphate esters and alkyl succinic acids. The corrosion inhibitor is preferably a sodium salt of dinonylnaphthalene sulfonic acid. The latter sodium salt is preferably present in a corrosion-inhibiting amount, more preferably in an amount within a range of from 0.05 wt % to 1 wt %, each weight percentage being based upon total composition weight.

Ingress of water into hydraulic fluids represents a common problem experienced in using hydraulic fluids. Water may come from a variety of sources including water based lubricants used near the hydraulic fluids and water from condensation. The presence of water in a hydraulic fluid can sometimes lead to formation of an emulsion. The emulsion often has higher compressibility which can cause reduced pump efficiency and cavitation. Ingress of water in the hydraulic oil can also lead to accelerated ferrous corrosion. Skilled artisans understand that one can use a demulsifier to separate water from the hydraulic fluid, thereby enabling one to drain water from a system that uses or moves a hydraulic fluid. Illustrative demulsifiers include polyoxyethylene alkyl phenols, their sulfonates and sodium sulfonates, polyamines, diepoxides, block and reverse block copolymers of ethylene oxide and propylene oxide, alkoxylated phenols and alcohols, alkoxylated amines and alkoxylated acids.

Viscosity index can be increased by adding, for example, polyisobutylenes, polymethacrylates, polyacrylates, vinyl acetates, ethylene propylene copolymers, styrene isoprene copolymers, styrene butadiene copolymers and styrene maleic ester copolymers.

Anti-foam additives reduce or prevent the formation of stable surface foam and are typically present in amounts from about 0.00003 wt % to about 0.05 wt %, based upon total lubricant blend composition weight. Polymethylsiloxanes, polymethacrylates, salts of alkylene dithiophosphates, amyl acrylate telomer and poly(2-ethylhexylacrylate-co-ethyl acrylate are non-limiting examples of anti-foam additives.

Detergents and dispersants are polar materials that serve a cleaning function. Detergents include metal sulfonates, metal salicylates and metal thiophosphonates. Dispersants include polyamine succinimides, hydroxy benzyl polyamines, polyamine succinimides, polyhydroxy succinic esters and polyamine amide imidazolines.

The compositions have a viscosity index or VI, determined as detailed below, that preferably lies above 120, more preferably above 140 and, still more preferably, above 150. VI's in excess of 400, while known, are rare. Skilled artisans recognize that VI indicates how a lubricant viscosity changes with temperature. For example, a low VI (e.g. 100) suggests that fluid viscosity will vary considerably when it is used to lubricate a piece of equipment that operates over a wide range of temperatures, such as from 20° C. to 100° C. Skilled artisans also recognize that as VI increases, lubricant performance also tends to improve. Based upon that recognition, skilled artisans prefer higher VI values (e.g. 150) over lower VI values (e.g. 100). For purposes of comparison, typical lubricant VI ranges are as follows: mineral oils=95 to 105; polyalphaolefins=120 to 140; synthetic esters=120 to 200 and polyalkylene glycols=170 to 300.

Analytical Procedures

Determine kinematic viscosity, in centistokes (cSt) and its metric equivalent, either square millimeters per second ($mm^2$/sec) or $1\times10^{-6}$ square meters per second, at 40° C. and 100° C. using a Stabinger viscometer in accord with American Society for Testing and Materials (ASTM) D7042. Use the kinematic viscosities to calculate a VI in accord with ASTM D2270.

Measure lubricant pour point in accord with ASTM D97-87.

Measure "pour point freezer" by placing samples in a freezer box for a period of several days at temperatures of respectively −10° C., −15° C., −20° C., −25° C. and −28° C.

Use Thermo-Gravimetric Analysis (TGA) to assess thermo-oxidative stability of lubricant materials. TGA assessment includes heating a lubricant sample at a rate of 10° C. per minute in flowing air and record lubricant weight loss versus temperature for two percent (2%) weight loss, 5% weight loss and 50% weight loss.

Measure dynamic friction coefficient using an Optimol SRV (Schwingungen Reibung Verschliess) friction apparatus comprising a steel plate and an oscillating steel ball. Place three drops of a candidate lubricant fluid on the plate, position the ball atop the plate, but disposed within the three drops of candidate fluid. For a test duration of one hour, apply a load of 200 Newtons (N) to the ball and perpendicular to the plate and use an oscillation frequency (of the ball on the plate) of 50 hertz and an oscillation distance of one millimeter (1 mm). Determine SRV friction coefficient (fc) at 30° C.

Use a Vickers Vane V-104C pump and a variation of ASTM D-7043 to evaluate potential lubrication properties of hydraulic fluids. For the variation, use a one gallon reservoir, rather than a five gallon reservoir according to ASTM D-7043, and implement a comprehensive cleaning procedure subsequent to each test run to effectively eliminate contamination from one test run to a succeeding test run. In the comprehensive cleaning procedure, strip the machine, clean the stripped parts and rebuild the machine, replacing worn parts as needed. Conduct wear testing at a pressure of 2000 psig (14 MPa), a rotary speed of 1200 revolutions per minute (rpm), a bulk fluid temperature of 65° C. and a test duration of 100 hours. Determine weight loss of pump vanes and rings and report combined weights as total weight loss during testing for each test run. The total weight loss is preferably less than 100 milligrams (mg), more preferably less than 50 mg.

Use a modified version of ASTM D2893 was used to measure thermo-oxidative stability. In the modified version, heat 300 ml of lubricant in a borosilicate glass tube that contains copper and iron metal coils to a set point temperature of 121° C. Blow dry air through the lubricant at a fixed rate of 35 ml/min. Measure lubricant kinematic viscosity (KV) every 3-4 days using procedures outlined in ASTM D7042. Terminate stability testing when lubricant KV exceeds 1.5 times $KV_1$ of the fluid.

EXAMPLES

The following examples illustrate, but do not limit, the present invention. All parts and percentages are based upon weight, unless otherwise stated. All temperatures are in ° C. Examples (Ex) of the present invention are designated by Arabic numerals and Comparative Examples (CE) are designated by capital alphabetic letters. Unless otherwise stated herein, "room temperature" and "ambient temperature" are nominally 25° C.

Ex 1 and Comp Ex A and B

In a 200 ml vessel, combine by blending with a stirrer bar, 71 grams (g) of high oleic canola oil (NATREON™ canola oil, commercially available from Dow AgraScience), 2 g of an additive package (L5168B, Lubrizol Corporation), 2 g of pour point depressant (L7671A, Lubrizol Corporation) and an amount of polyether (SYNALOX 100-30B for Ex 1), or polyolester-1 (EDENOR™ TMTC, Cognis) for Comp Ex A or polyolester-2 (PRIOLUBE™ 1426, Uniquema) for Comp Ex B sufficient to provide a lubricant blend composition that is miscible and has a polyether or polyolester, whichever is appropriate, content of 25 wt %, based upon combined weight of polyether or polyolester, high oleic vegetable oil and additives (pour point depressant and additive package). Subject the resulting lubricant blend compositions to analytical testing and summarize test results in Table 2 below.

TABLE 2

| Ex/ Comp Ex No | Pour Point (° C.) | Pour Point Freezer (° C.) | Visc at 40° C. ($mm^2/s$) | Visc at 100° C. ($mm^2/s$) | VI | SRV fc at 30° C. |
|---|---|---|---|---|---|---|
| 1 | −27 | −25* | 46.7 | 10.1 | 211 | 0.104 |
| A | −30 | −28 | 39.1 | 8.76 | 213 | 0.106 |
| B | −29 | −28** | 49.3 | 10.5 | 209 | 0.094 |

*means liquid plus crystals;
**means solid

For purposes of comparison, neat high oleic canola oil (NATREON canola oil) in combination with 2 parts by weight (pbw), per hundred pbw of neat high oleic seed oil, of the L5186B additive package has a pour point >−22° C., a pour point freezer >−10° C. (already solid), a viscosity at 40° C. of 37.6 $mm^2/s$, a viscosity at 100° C. of 8.34 $mm^2/s$, a VI of 207 and a SRV fc of 0.100. Neat high oleic seed oil in combination with 2 pbw of L5186B additive package and 2 pbw of L7671A pour point depressant, in each case per hundred pbw of neat high oleic canola oil, has a pour point of −26° C., a pour point freezer of −25° C. (already solid), a viscosity at 40° C. of 46.1 $mm^2/s$, a viscosity at 100° C. of 10.2 $mm^2/s$, a VI of 218 and a SRV fc of 0.096.

Ex 2 and Comp Ex C and D

Replicate Ex 1, Comp Ex A and Comp Ex B, but increase respective amounts of polyether or polyolester such that the lubricant blend composition contains 40 wt % polyether or polyolester, whichever is appropriate. Subject the resulting lubricant blend compositions to analytical testing as in Ex 1, Comp Ex A and Comp Ex B and summarize test results in Table 3 below.

TABLE 3

| Ex No | Pour Point (° C.) | Pour Point Freezer (° C.) | Visc at 40° C. ($mm^2/s$) | Visc at 100° C. ($mm^2/s$) | VI | SRV fc at 30° C. |
|---|---|---|---|---|---|---|
| 2 | −29 | −28*** | 47.6 | 10.2 | 209 | 0.112 |
| C | −37 | −28**** | 35.7 | 7.98 | 206 | 0.108 |
| D | −39 | −28**** | 51.2 | 10.8 | 208 | 0.095 |

***means semi-solid;
****means turbid liquid

Ex 3

Replicate Ex 1 but use 20 wt % of the same polyether as in Ex 1 and 20 wt % of the polyolester as in Comp Ex B in conjunction with 56 wt % high oleic seed oil, 2 wt % of the same additive package as in Ex 1 and 2 wt % of the same pour point depressant as in Ex 1, each weight percent being based upon combined weight of polyether, polyolester and seed oil, to prepare a lubricant blend composition. Subject the resulting lubricant blend composition to analytical testing as in Ex 1 and summarize test results in Table 4 below.

TABLE 4

| Ex No | Pour Point (° C.) | Pour Point Freezer (° C.) | Visc at 40° C. ($mm^2/s$) | Visc at 100° C. ($mm^2/s$) | VI | SRV fc at 30° C. |
|---|---|---|---|---|---|---|
| 3 | −33 | −28** | 48.8 | 10.5 | 212 | 0.102 |

**means solid

The data in Tables 2, 3 and 4 illustrate several points. First, lubricant blend compositions representative of the present invention and based on high oleic seed oil (e.g. NATREON™ high oleic canola oil) and a polyether (25 wt % to 40 wt %, based upon combined weight of seed oil and polyether) are stable and homogeneous liquids at room temperature (nominally 25° C.). Second, use of a co-fluid such as a polyether in the foregoing amounts improves low temperature properties (e.g. pour point) of seed oils, especially high oleic seed oils, without adversely affecting performance of such seed oils from a viscosity or friction coefficient point of view. A friction coefficient of less than 0.12 under these test conditions is considered to be low and favorable. Third, including a pour point depressant in lubricant blend compositions of the present invention improves low temperature properties (e.g. pour point). Fourth, the data, specifically low temperature stability, viscosity and SRV friction coefficient data, suggest that lubricant blend compositions of the present invention have potential utility in power transmission applications, e.g. as hydraulic oils or fluids. Fifth, compositions that contain a polyolester as well as a polyether, as in Ex 3, provide very satisfactory results in terms of the properties shown in Table 4. CE A and B, relative to Example 1, and Comparative Example C and D, relative to Example 2 demonstrate that polyethers blend well with seed oils and give properties comparable to those attained with blends of seed oils and commercial polyol esters. In other words, polyethers effectively substitute for all of a polyolester, as in Ex 1 and Ex 2, or only part of a polyolester as in Ex 3. Compositions of the present invention that comprise a seed oil, a polyether and an optional polyolester function as lubricant materials with desirable low temperature properties, but without compromising viscosity or friction coefficient properties.

Ex 4-6 and CE E-CE O

In a 20 liter (L) vessel, prepare a base oil blend by stirring together 6000 g of the same high oleic canola oil as used in Ex 1, 1500 g of a butanol-initiated propoxylate that has an average molecular weight of 740 (UCON™ LB 165, The Dow Chemical. Company) (PPO-1) and 2500 g of a butanol-initiated propoxylate that has an average molecular weight of 1020 (UCON™ LB285, The Dow Chemical Company) (PPO-2). The base oil blend has a weight ratio of high oleic canola oil to total butanol-initiated propoxylate of 60/40.

Evaluate a number of different antioxidants to determine whether they impart sufficient oxidative stability to the base oil to provide an increase in kinematic viscosity (KV) between initial KV ($KV_1$) and a KV after 13 days ($KV_{13}$) of less than 50% by combining an amount of antioxidant with an aliquot of the base oil blend as shown in Table 5 below. The antioxidant is one or more of: AO-A, a thiodiethylene bis[3-(3,5-di-tert-butyl-4-hydroxyphenyl)propionate] (IRGANOX™ L115, Ciba); AO-B, a N-phenyl-ar-(1,1,3,3-tetramethylbutyl)-1-naphthalene (IRGANOX L06, Ciba); AO-C, pentaerythritol tetrakis(3-(3,5-di-tert-butyl-4-hydroxyphenyl)propionate) (IRGANOX L101, Ciba); AO-D, a reaction product of N-phenyl benzenamine with 2,4,4-trimethyl pentene and 2-methylpropene (VANLUBE™ 961, R. T. Vanderbilt); AO-E, a reaction product of N-phenyl benzenamine with 2,4,4-trimethyl pentene (VANLUBE 81, R. T. Vanderbilt); AO-F, an alkyl ester of 3,5-bis(1,1-dimethylethyl)-4-hydroxy-benzenepropanoic acid (NALUBE™ AO-242, King Industries); and AO-G, a blend of $C_7$ to $C_9$ branched alkyl esters of 3,5-di-tert-butyl-4-hydroxyhydrocinnaic acid (IRGANOX L135, Ciba). Express all amounts in Table 5 in terms of wt %, based upon combined weight of base oil blend and antioxidant.

Subject the antioxidant/base oil blend combinations to kinematic viscosity testing at 40° C., both initially and after time periods as shown in Table 6. Table 6 also includes kinematic viscosity test results (in $mm^2/sec$). Stop KV testing at less than 11 days where data either show an increase in viscosity of more than 50% or suggest that, based upon marked increases in viscosity for shorter periods of time that KV testing at 11 days would exceed 50%. Note that 1 $mm/sec^2$ equals 1 cSt.

TABLE 5

| | CE E | CE F | CE G | CE H | Ex 4 | CE I | CE J | CE K | Ex 5 | CE L | CE M | Ex 6 | CE N | CE O |
|---|---|---|---|---|---|---|---|---|---|---|---|---|---|---|
| Base Oil Blend | 99.5 | 99.5 | 99.5 | 99.5 | 99.5 | 99.5 | 99.5 | 99.0 | 99.0 | 99.0 | 99.0 | 99.0 | 99.0 | 99.0 |
| AO-B | 0.5 | | | | | | | 1 | | | | | | |
| AO-C | | 0.5 | | | | | | | 1 | | | | | |
| AO-D | | | 0.5 | | | | | | | 1 | | | | |
| AO-E | | | | 0.5 | | | | | | | 1 | | | |
| AO-A | | | | | 0.5 | | | | | | | 1 | | |
| AO-F | | | | | | 0.5 | | | | | | | 1 | |
| AO-G | | | | | | | 0.5 | | | | | | | 1 |

TABLE 6

| | CE E | CE F | CE G | CE H | Ex 4 | CE I | CE J | CE K | Ex 5 | CE L | CE M | Ex 6 | CE N | CE O |
|---|---|---|---|---|---|---|---|---|---|---|---|---|---|---|
| $KV_1$ | 39.9 | 40.2 | 39.9 | 40.0 | 39.8 | 40.1 | 40.2 | 40.3 | 40.9 | 40.6 | 40.2 | 40.3 | 39.5 | 39.5 |
| $KV_4$ | 45.3 | 41.1 | 59.8 | 60.2 | 40.6 | 45.3 | 45.6 | 44.0 | 41.4 | 62.4 | 60.8 | 40.8 | 41.1 | 41.4 |
| $KV_7$ | 62.4 | 45.3 | | | 41.9 | 60.2 | 58.4 | 52.5 | 42.4 | | | 42.3 | 46.0 | 50.8 |

TABLE 6-continued

| | CE E | CE F | CE G | CE H | Ex 4 | CE I | CE J | CE K | Ex 5 | CE L | CE M | Ex 6 | CE N | CE O |
|---|---|---|---|---|---|---|---|---|---|---|---|---|---|---|
| $KV_{11}$ | | 75.4 | | | 49.4 | | | | 42.8 | | | 43.9 | 75.9 | |
| $KV_{14}$ | | | | | 70.0 | | | | 44.0 | | | 58.5 | | |
| $KV_{15}$ | | | | | | | | | | | | 89.2 | | |
| $KV_{19}$ | | | | | | | | | 61.6 | | | | | |
| $KV_{26}$ | | | | | | | | | 136.5 | | | | | |
| % Change 11 days or less | 56.4 | 87.6 | 49.9 | 50.5 | 24.1 | 50.1 | 45.3 | 30.3 | 4.6 | 53.7 | 51.2 | 8.9 | 92.2 | 28.6 |
| % Change 14 days | | | | | 75.9 | | | | 7.6 | | | 45.2 | | |

The data presented in Table 6 suggests that antioxidants AO-A and AO-C both provide a viscosity increase after 11 days of less than 10% when used in an amount of 1 wt % based upon combined weight of antioxidant and base oil while only AO-A provides a viscosity increase after 11 days of less than 50% when used in an amount of 0.5 wt % based upon combined weight of antioxidant and base oil.

Ex 7-Ex 21 and CE P

Using the same procedure as in Ex 4 above, evaluate combinations of AO-A and AO-B through AO-H in amounts as shown in Table 7 below. Although normally classed as a corrosion inhibitor, for purposes of Tables 7, 9 and 11, AO-H is a sodium salt of dinonylnaphthalene sulfonic acid (Na-Sul™ SS, King Industries). Table 8 below shows kinematic viscosity (KV) test results for various time intervals as well as $KV_1$. Table 8 also includes data for Ex 6.

The data in Table 8 show that, at a total antioxidant loading of 1.5 wt %, each of AO-B through AO-H provide a reduction in viscosity increase, when added at a 0.5 wt % loading in conjunction with 1.0 wt % of AO-A, relative to 1.5 wt % of AO-A alone. The data also show that, at a total antioxidant loading of 2.0 wt %, only AO-C and AO-F provide a reduction in viscosity increase, when added at a 1.0 wt % loading in conjunction with 1.0 wt % of AO-A, relative to 2.0 wt % of AO-A alone. Data for combinations of AO-B, AO-D, AO-E and AO-G, also at a 1.0 wt % loading in conjunction with 1.0 wt % of AO-A, while not as good as that for AO-C and AO-F, still provide improvements relative to AO-B, AO-D, AO-E and AO-G alone at a loading of 0.5 wt % as shown in Table 6 above. The data in Table 8 further show that increasing amounts of AO-A alone also provide improvements in terms of reducing viscosity increase. At 1.5 wt % AO-A alone, viscosity increase reductions exceed those of AO-A with any of AO-B through AO-H. At 2.0 wt % AO-A alone, only combinations of AO-A with either of AO-C and AO-F, as

TABLE 7

| | Ex 6 | Ex 7 | Ex 8 | Ex 9 | Ex 10 | Ex 11 | Ex 12 | Ex 13 | Ex 14 | Ex 15 | Ex 16 | Ex 17 | Ex 18 | Ex 19 | Ex 20 | Ex 21 | CE P |
|---|---|---|---|---|---|---|---|---|---|---|---|---|---|---|---|---|---|
| Base Oil Blend | 99 | 98.5 | 98.5 | 98.5 | 98.5 | 98.5 | 98.5 | 98.5 | 98.5 | 98 | 98 | 98 | 98 | 98 | 98 | 98 | 98 |
| AO-A | 1 | 1.5 | 1 | 1 | 1 | 1 | 1 | 1 | 1 | 2 | 1 | 1 | 1 | 1 | 1 | 1 | 1 |
| AO-B | | | 0.5 | | | | | | | | 1 | | | | | | |
| AO-C | | | | 0.5 | | | | | | | | 1 | | | | | |
| AO-D | | | | | 0.5 | | | | | | | | 1 | | | | |
| AO-E | | | | | | 0.5 | | | | | | | | 1 | | | |
| AO-F | | | | | | | 0.5 | | | | | | | | 1 | | |
| AO-G | | | | | | | | 0.5 | | | | | | | | 1 | |
| AO-H | | | | | | | | | 0.5 | | | | | | | | 1 |

TABLE 8

| | Ex 6 | Ex 7 | Ex 8 | Ex 9 | Ex 10 | Ex 11 | Ex 12 | Ex 13 | Ex 14 | Ex 15 | Ex 16 | Ex 17 | Ex 18 | Ex 19 | Ex 20 | Ex 21 | CE P |
|---|---|---|---|---|---|---|---|---|---|---|---|---|---|---|---|---|---|
| $KV_1$ | 40.1 | 40.6 | 40.7 | 40.9 | 40.6 | 40.7 | 40.3 | 40.4 | 40.8 | 41.3 | 41.2 | 41.7 | 40.9 | 41.1 | 40.4 | 40.3 | 41.4 |
| $KV_3$ | 40.7 | 41.9 | 40.9 | 41.1 | 41.0 | 41.5 | 40.6 | 40.7 | 41.2 | 41.4 | 41.6 | 42.1 | 41.2 | 41.4 | 41.3 | 41.3 | 42.2 |
| $KV_7$ | 41.9 | 43.1 | 42.4 | 42.3 | 42.5 | 42.9 | 42.0 | 42.1 | 43.1 | 42.7 | 43.3 | 43.2 | 42.9 | 43.1 | 42.0 | 42.1 | 44.4 |
| $KV_{10}$ | 43.4 | 42.7 | 43.4 | 43.2 | 43.6 | 44.3 | 43.2 | 43.0 | 44.7 | 43.5 | 44.6 | 44.0 | 44.2 | 44.5 | 43.4 | 44.1 | 47.6 |
| $KV_{13}$ | 57.1 | 52.7 | 45.2 | 44.9 | 46.1 | 49.3 | 46.0 | 45.2 | 46.8 | 45.2 | 47.5 | 45.2 | 47.3 | 47.9 | 45.1 | 48.3 | 69.2 |
| $KV_{16}$ | 86.9 | 105.9 | 47.3 | 47.2 | 49.4 | 67.5 | 62.9 | 47.9 | 48.7 | 47.7 | 51.1 | 46.5 | 50.8 | 57.0 | 49.9 | 82.4 | |
| $KV_{20}$ | | | 59.5 | 66.9 | 82.4 | | | 73.7 | 54.9 | 54.9 | 70.2 | 49.4 | 69.6 | 92.2 | 68.2 | | |
| $KV_{23}$ | | | 83.5 | | | | | | 69.1 | 79.5 | | 52.7 | | | | | |
| $KV_{27}$ | | | | | | | | | | | | 78.0 | | | | | |
| % KV change after 13 days | 42.4 | 29.8 | 11.1 | 9.8 | 13.5 | 21.1 | 14.1 | 11.9 | 14.7 | 9.4 | 15.3 | 8.4 | 16.6 | 16.5 | 9.2 | 19.9 | 67.1 |

noted above, provide a lower reduction in viscosity increase. AO-H, while quite acceptable at a 0.5 wt % loading in conjunction with 1.0 wt % of AO-A, does not provide satisfactory results when used at a level of 1.0 wt % in conjunction with 1.0 wt % of AO-A. Each wt % is based upon combined weight of base oil and antioxidants.

Ex 22 through Ex 38 and CE Q

Use the same procedure as that used for Ex 6, but with AO-C either alone or in conjunction with another antioxidant. Table 9 below shows amounts of each antioxidant. Table 10 shows KV data. For Tables 9 and 10, AO-I represents an amine phosphate, normally classified as an anti-wear additive (NALUBE™ 6110, King Industries). As with Ex 6-21 and CE P, each wt % is based upon combined weight of base oil and antioxidants.

The data in Table 10 show that AO-C alone, at loadings of 1 wt %, 1.5 wt % and 2 wt %, provides a satisfactorily low increase between $KV_1$ and $KV_{14}$, with 1 wt % and 2 wt % being better than 1.5 wt % at $KV_{14}$, but 1.5 wt % being better than 1 wt % and 2 wt % being better than 1.5 wt % at longer time intervals such as $KV_{22}$. The data also show that AO-C, when used in combination with 0.5 wt % of any of AO-A, AO-B and AO-D through AO-1, provides a very satisfactorily low increase between $KV_1$ and $KV_{14}$. The same holds for all antioxidants tested other than AO-I at a 1 wt % loading in conjunction with 1 wt % of AO-C. As with combinations of AO-A with another antioxidant, combinations of AO-C with AO-H at a 1 wt % loading is much worse, in terms of viscosity increase, than the combination of 1 wt % AO-C and 0.5 wt % AO-H.

TABLE 9

| | Ex 22 | Ex 23 | Ex 24 | Ex 25 | Ex 26 | Ex 27 | Ex 28 | Ex 29 | Ex 30 | Ex 31 | Ex 32 | Ex 33 | Ex 34 | Ex 35 | Ex 36 | Ex 37 | Ex 38 | CE Q |
|---|---|---|---|---|---|---|---|---|---|---|---|---|---|---|---|---|---|---|
| Base Oil Blend | 99 | 98.5 | 98.5 | 98.5 | 98.5 | 98.5 | 98.5 | 98.5 | 98.5 | | 98 | 98 | 98 | 98 | 98 | 98 | 98 | 98 |
| AO-C | 1 | 1.5 | 1 | 1 | 1 | 1 | 1 | 1 | 1 | 1 | 2 | 1 | 1 | 1 | 1 | 1 | 1 | 1 |
| AO-B | | | 0.5 | | | | | | | | | 1 | | | | | | |
| AO-D | | | | 0.5 | | | | | | | | | 1 | | | | | |
| AO-E | | | | | 0.5 | | | | | | | | | 1 | | | | |
| AO-A | | | | | | 0.5 | | | | | | | | | 1 | | | |
| AO-F | | | | | | | 0.5 | | | | | | | | | 1 | | |
| AO-G | | | | | | | | 0.5 | | | | | | | | | 1 | |
| AO-H | | | | | | | | | 0.5 | | | | | | | | | 1 |
| AO-I | | | | | | | | | | 0.5 | | | | | | | | |

TABLE 10

| | Ex 22 | Ex 23 | Ex 24 | Ex 25 | Ex 26 | Ex 27 | Ex 28 | Ex 29 | Ex 30 | Ex 31 | Ex 32 | Ex 33 | Ex 34 | Ex 35 | Ex 36 | Ex 37 | Ex 38 | CE Q |
|---|---|---|---|---|---|---|---|---|---|---|---|---|---|---|---|---|---|---|
| $KV_1$ | 40.9 | 41.4 | 41.3 | 41.1 | 41.2 | 41.3 | 40.8 | 40.9 | 41.4 | 41.2 | 42.2 | 41.8 | 41.5 | 41.7 | 41.7 | 41.0 | 41.0 | 42.0 |
| $KV_4$ | 41.4 | 42.3 | 42.5 | 42.3 | 42.4 | 42.3 | 42.0 | 42.0 | 42.4 | 42.7 | 42.6 | 43.1 | 42.6 | 42.8 | 42.8 | 41.9 | 42.1 | 43.5 |
| $KV_7$ | 42.4 | 43.5 | 43.3 | 43.1 | 43.2 | 43.1 | 42.9 | 42.9 | 43.6 | 44.7 | 44.0 | 44.0 | 43.5 | 43.8 | 43.6 | 42.9 | 43.0 | 45.6 |
| $KV_{11}$ | 42.8 | 44.3 | 44.6 | 44.0 | 44.1 | 44.2 | 44.4 | 44.4 | 45.1 | ** | ** | 45.4 | 44.8 | 45.0 | 44.7 | 44.1 | 44.3 | 50.5 |
| $KV_{14}$ | 44.0 | 45.7 | 46.2 | 44.9 | 45.2 | 45.7 | 46.6 | 46.4 | 46.2 | 50.9 | 45.2 | 46.8 | 47.5 | 47.1 | 46.1 | 45.2 | 45.5 | 80.5 |
| $KV_{19}$ | 61.6 | 48.7 | 68.5 | 49.1 | 69.8 | 51.8 | 81.6 | 72.0 | 48.3 | 97.1 | 47.6 | 51.4 | 73.8 | 76.4 | 49.8 | 48.7 | 48.4 | |
| $KV_{22}$ | 74.7 | 51.1 | | 65.6 | | 72.7 | | | 49.5 | | 49.7 | 59.6 | | | 72.3 | 56.9 | 52.4 | |
| $KV_{26}$ | 136.5 | 67.2 | | | | | | | 51.5 | | ** | 89.3 | | | | 83.0 | 70.7 | |
| $KV_{29}$ | | | | | | | | | 53.3 | | 71.1 | | | | | | | |
| % KV change after 14 days | 7.6 | 10.4 | 11.9 | 9.2 | 9.7 | 10.6 | 14.2 | 13.4 | 11.6 | 21.1 | 7.1 | 12.0 | 14.5 | 12.9 | 10.6 | 10.2 | 11.0 | 91.7 |

** means not measured

Ex 39-Ex 47 and CE R

Use the same procedure as in Ex 6, but with a combination 1 wt % AO-C and 0.5 wt % AO-I, either alone or in conjunction with another antioxidant. Table 11 below shows amounts of each antioxidant. Table 12 shows KV data. As with Ex 6-21 and CE P, each wt % is based upon combined weight of base oil and antioxidants.

TABLE 11

| | Ex 39 | Ex 40 | Ex 41 | Ex 42 | Ex 43 | Ex 44 | Ex 45 | CE R | Ex 46 | Ex 47 |
|---|---|---|---|---|---|---|---|---|---|---|
| Base Oil Blend | 98.5 | 98.0 | 98.0 | 98.0 | 98.0 | 98.0 | 98.0 | 98.0 | 98.0 | 98.5 |
| AO-C | 1 | 1.5 | 1 | 1 | 1 | 1 | 1 | 1 | 1 | 1 |

TABLE 11-continued

| | Ex 39 | Ex 40 | Ex 41 | Ex 42 | Ex 43 | Ex 44 | Ex 45 | CE R | Ex 46 | Ex 47 |
|---|---|---|---|---|---|---|---|---|---|---|
| AO-I | 0.5 | 0.5 | 0.5 | 0.5 | 0.5 | 0.5 | 0.5 | 0.5 | 0.5 | |
| AO-B | | | 0.5 | | | | | | | |
| AO-D | | | | 0.5 | | | | | | |
| AO-E | | | | | 0.5 | | | | | |
| AO-A | | | | | | 0.5 | | | | |
| AO-F | | | | | | | 0.5 | | | |
| AO-G | | | | | | | | 0.5 | | |
| AO-H | | | | | | | | | 0.5 | 0.5 |

TABLE 12

| | Ex 39 | Ex 40 | Ex 41 | Ex 42 | Ex 43 | Ex 44 | Ex 45 | CE R | Ex 46 | Ex 47 |
|---|---|---|---|---|---|---|---|---|---|---|
| $KV_1$ | 41.3 | 42.6 | 41.6 | 41.5 | 41.7 | 41.7 | 41.2 | 41.5 | 44.7 | 41.2 |
| $KV_4$ | 42.7 | 42.6 | 43.5 | 43.1 | 44.4 | 43.7 | 42.6 | 43.0 | 44.6 | 42.6 |
| $KV_7$ | 44.7 | 45.3 | 45.2 | 44.5 | 45.9 | 45.4 | 44.9 | 46.2 | 45.6 | 43.5 |
| $KV_{11}$ | 47.3 | 45.2 | 48.0 | 46.6 | 47.7 | 48.0 | 47.0 | 54.8 | 46.8 | ** |
| $KV_{14}$ | 50.9 | 48.9 | 50.0 | 47.9 | 49.1 | 49.7 | 49.6 | 68.2 | 47.7 | 45.7 |
| $KV_{18}$ | 56.5 | 54.0 | 52.8 | 49.6 | 51.4 | 51.5 | 51.5 | | 48.8 | ** |
| $KV_{21}$ | 97.1 | 55.3 | 55.1 | 50.7 | 53.3 | 53.2 | 53.9 | | 49.8 | 48.7 |
| $KV_{24}$ | | 60.2 | 58.2 | 51.9 | 57.0 | 56.0 | 56.7 | | 50.7 | 53.0 |
| $KV_{27}$ | | 67.1 | 63.2 | 53.2 | 83.2 | 58.3 | 68.4 | | 51.7 | 67.2 |
| $KV_{31}$ | | | 96.3 | 55.5 | | 62.6 | | | 53.0 | |
| $Kv_{34}$ | | | | 57.6 | | 85.2 | | | 54.0 | |
| $Kv_{38}$ | | | | 61.9 | | | | | 55.3 | |
| $KV_{41}$ | | | | 99.9 | | | | | 57.8 | |
| $KV_{45}$ | | | | | | | | | 62.9 | |
| $KV_{48}$ | | | | | | | | | 68.1 | |
| % KV change after 14 days | 23.2 | 14.8 | 20.2 | 15.4 | 17.7 | 19.2 | 20.4 | 64.3 | 6.7 | 10.9 |

** means not measured

The data in Table 12 show that, at a total antioxidant loading of 2 wt %, only Ex 46 (a combination of AO-C, AO-I and AO-H) provides exceptional results in terms not only of viscosity increase between $KV_1$ and $KV_{14}$, but also between $KV_1$ and $KV_{48}$. Other combinations (e.g. Ex 41, Ex 42, Ex 43, Ex 44, 45 and Ex 47), while not as good as Ex 40 (a combination of only AO-C and AO-I) at $KV_{14}$, clearly provide an improvement over Ex 40 in terms of having a lower level of viscosity increase at longer times such $KV_{24}$ Comp Ex S through Comp Ex U.

Perform KV testing for four commercially available biohydraulic oils at time intervals shown in Table 11 below. The oil for Comp Ex S is Mobil EAL 224H, commercially available from Exxon/Mobil. The oil for Comp Ex T is Eco-hyd™ 46, commercially available from Fuchs. The oil for Comp Ex U is PlanetLube™ HydroBio™ S-46, commercially available from Cargill. The oil for Comp Ex V is Plantohyd™ 40N, commercially available from Fuchs.

TABLE 13

| | CE S | CE T | CE U | CE V |
|---|---|---|---|---|
| $KV_1$ | 37.6 | 46.0 | 44.2 | 44.2 |
| $KV_5$ | 40.4 | 48.7 | 46.1 | 49.8 |
| $KV_9$ | 48.3 | 59.0 | 45.1 | 54.1 |
| $KV_{11}$ | 68.4 | 78.0 | 50.8 | 97.1 |
| $KV_{13}$ | 116.2 | 126.4 | 94.6 | |
| $KV_{27}$ | 175.4 | 181.8 | | |

A comparison of the data in Table 13 with that of any of Tables 6, 8, 10 and 12 suggests that compositions of the present invention that comprise a vegetable or seed oil, at least one polyether and a combination of certain additives, predominantly antioxidants, provide very solid performance in terms of minimizing viscosity increase after, for example 11 and 13 days, relative to the commercial materials represented by CE S through CE V.

Ex 48 through Ex 51 and CE W through CE AC

Prepare a series of lubricant blends for CE X through CE AB and Ex 48 through Ex 51 by replicating Ex 4 and the same base oil components as in Ex 4 (high oleic canola oil or "HOCO", PPO-1 and PPO-2), but with compositions as shown in Table 14 below wherein all percentages are weight percentages based upon total blend weight. In addition, prepare lubricant blend CE W by blending 0.75 wt % of AO-J, an aminic antioxidant (IRGANOX™ L57, Ciba) with 99.25 wt % of a high oleic-containing vegetable oil (TRISUN™ 80, _Dow Agroscience), each wt % being based upon total lubricant blend weight. CE AC is the commercially available biohydraulic oil of CE S. Additional additives include AO-K, an organic sulfur and phosphorous compound (VANLUBE™ 9611M, R. T. Vanderbilt), AO-L, an antiwear additive that contains a triazole derivative (NALUBE™ AW6220, King Industries), and AO-M, an ashless antiwear additive (NALUBE™ AW6330, King Industries).

Subject the lubricant blends and lubricants to KV testing (initial (KVI) and at time intervals of 24 hours ($KV_{24}$), 48 hours ($KV_{48}$), 72 hours ($KV_{72}$) and 100 hours ($KV_{100}$)) and wear testing, with wear on rings and vanes as well as total wear expressed in milligrams (mg). Table 15 below summarizes KV and wear test results.

TABLE 14

| | CE X | CE Y | Ex 48 | Ex 49 | Ex 50 | CE Z | Ex 51 | CE AA | CE AB |
|---|---|---|---|---|---|---|---|---|---|
| HOCO | 60 | 60 | 60 | 60 | 60 | 60 | 60 | 60 | 98.35 |
| PPO-1 | 15 | 19.25 | 14.1 | 14.1 | 14.1 | 14.1 | 14.5 | 14.5 | |
| PPO-2 | 24.25 | 20 | 24.25 | 24.25 | 24.25 | 24.25 | 24.25 | 24.25 | |
| AO-I | | | | 0.9 | | | 0.5 | | |
| AO-J | 0.75 | 0.75 | 0.75 | 0.75 | 0.75 | 0.75 | 0.75 | 0.75 | 0.75 |
| AO-K | | | 0.9 | | | | | 0.5 | 0.9 |
| AO-L | | | | | 0.9 | | | | |
| AO-M | | | | | | 0.9 | | | |

TABLE 15

| | CE W | CE X | CE Y | Ex 48 | Ex 49 | Ex 50 | CE Z | Ex 51 | CE AA | CE AB | CE AC |
|---|---|---|---|---|---|---|---|---|---|---|---|
| $KV_1$ | 40.8 | 40.1 | 39.0 | 39.2 | 39.8 | 40.1 | 39.6 | 40 | 39.6 | 38.4 | 36.8 |
| $KV_{24}$ | 41.2 | 40.8 | 39.2 | ** | 40.8 | 34.2 | ** | ** | ** | ** | ** |
| $KV_{48}$ | 42.0 | 41.3 | 40.0 | ** | ** | ** | ** | ** | ** | ** | ** |
| $KV_{72}$ | 43.4 | 42.3 | 40.6 | 40.9 | ** | 41.3 | ** | ** | ** | ** | ** |
| $KV_{100}$ | 44.8 | 42.6 | 41.0 | 41.8 | 42.3 | 42.7 | 43.7 | 42.7 | 43.3 | 41.4 | 37.4 |
| Ring Wear (mg) | 304.8 | 226.9 | 193 | 5.4 | 0.2 | 2.3 | 1030.7 | 0 | 931.6 | 339.6 | 0 |
| Vane Wear (mg) | 41 | 80.9 | 62 | 2.1 | 2.9 | 2.4 | 45 | 2.4 | 5.6 | 8.7 | 4.8 |
| Total Wear (mg) | 345.8 | 307.8 | 255 | 7.5 | 3.1 | 4.7 | 1075.7 | 2.4 | 937.2 | 348.3 | 4.8 |
| Rating | Fail | Fail | Fail | Pass | Pass | Pass | Fail | Pass | Fail | Fail | Pass |

** means not measured

The data presented in Table 15 show that for embodiments of this invention in which wear resistance is a preferred performance attribute, certain formulations that fall within the scope of appended claims, specifically the formulations of Ex 48 through Ex 51, deliver a combination of low KV increase and desirable wear resistance that approximates or even improves upon that of the commercial hiohydraulic lubricant of CE AC.

The invention claimed is:

1. A lubricant blend composition comprising at least one first component, the first component being a vegetable oil or seed oil, and at least one second component, the second component being a polyether, the first component being present in an amount in excess of 10 percent by weight and up to 85 weight percent and the second component being present in an amount of at least 15 weight percent and less than 90 percent by weight, each percent by weight being based upon combined weight of first component and second component and, when taken together total 100 wt %, the blend having an ASTM D97-87 pour point of −10° C. or lower, a viscosity at 40° C. within a range of from 10 $mm^2/s$ to 100 $mm^2/s$, a viscosity at 100° C. within a range of from 2.4 $mm^2/s$ to 20 $mm^2/s$, and a viscosity index within a range of from 30 to 225.

2. The composition of claim 1, further comprising a wear-reducing amount of amine phosphate, the wear-reducing amount being within a range of from 0.05 percent by weight to 3 percent by weight, each weight percentage being based upon total composition weight.

3. The composition of claim 1, further comprising at least one antioxidant selected from a group consisting of phenolic antioxidants and amine antioxidants, the antioxidant(s) being present in a total amount within a range of from 0.5 percent by weight to 10 percent by weight, each weight percentage being based upon total composition weight.

4. The composition of claim 3, wherein at least one antioxidant is a phenolic antioxidant that has a molecular weight of at least 220 g/mole.

5. The composition of any of claim 1, further comprising a corrosion-inhibiting amount of a sodium salt of dinonylnaphthalene sulfonic acid or a calcium salt of dinonylnaphthalene sulfonic acid.

6. The composition of claim 5, further comprising a demulsifier.

7. The composition of claim 6, wherein the demulsifier is selected from a group consisting of polyoxyethylene alkyl phenols, their sulfonates and sodium sulfonates, polyamines, diepoxides, block and reverse block copolymers of ethylene oxide and propylene oxide, alkoxylated phenols and alcohols, alkoxylated amines and alkoxylated acids.

8. The composition of claim 1, wherein the first component is present in an amount within a range of from 15 percent by weight to 80 percent by weight, based upon combined weight of first and second components.

9. The composition of claim 1, wherein the first component is at least one of a natural vegetable oil, a synthetic vegetable oil and a high oleic content vegetable oil, the high oleic oil being selected from the group consisting of high oleic canola oil, high oleic soybean oil, high oleic sunflower oil and high oleic safflower oil.

10. The composition of claim 1, further comprising a pour point depressant in an amount within a range of from greater than 0 percent by weight to about 2 percent by weight, each weight percentage being based upon total composition weight.

11. The composition of claim 1, wherein the polyether is a polyalkyleneglycol or modified polyalkylene glycol, the modified polyalkylene glycol being an end-capped polyalkylene glycol, the end-capped polyalkylene glycol including a non-reactive end-capping moiety selected from a group consisting of an alkyl ether, wherein the alkyl ether has an alkyl moiety that contains from one to 1-30 carbon atoms, or an aromatic ether group.

12. The composition of claim 1 wherein the second component further comprises a polyolester, the polyolester being a synthetic ester of a polyhydric alcohol and a $C_6$-$C_{22}$ acid, the polyhydric alcohol being at least one of trimethylolpropane, neopentylglycol, pentaerythritol, dipentaerythritol, and 1,2, 3-trihydroxy-propanol.

13. The composition of claim 1, wherein the composition yields a total weight loss of ring and vanes in a Vickers Vane V104C pump test of less than 100 milligrams as measured in accord with ASTM D7043.

14. The composition of claim 13, wherein the total ring and vanes weight loss is less than or equal to 50 milligrams.

* * * * *